US009139271B2

(12) United States Patent
Beach-Drummond

(10) Patent No.: US 9,139,271 B2
(45) Date of Patent: Sep. 22, 2015

(54) SPLASH-RESISTANT AUTOMATICALLY INFLATABLE FLOTATION DEVICE

(71) Applicant: MARINE SAFETY PRODUCTS, LLC, Kissimmee, FL (US)

(72) Inventor: James Beach-Drummond, Winter Park, FL (US)

(73) Assignee: MARINE SAFETY PRODUCTS, LLC, Kissimmee, FL (US)

( * ) Notice: Subject to any disclaimer, the term of this patent is extended or adjusted under 35 U.S.C. 154(b) by 0 days.

(21) Appl. No.: 13/973,035

(22) Filed: Aug. 22, 2013

(65) Prior Publication Data

US 2014/0057510 A1 Feb. 27, 2014

Related U.S. Application Data

(60) Provisional application No. 61/692,503, filed on Aug. 23, 2012.

(51) Int. Cl.

| | |
|---|---|
| ***B63C 9/08*** | (2006.01) |
| ***B63C 9/125*** | (2006.01) |
| *B63C 9/00* | (2006.01) |

(52) U.S. Cl.

CPC ..... *B63C 9/081* (2013.01); *B63C 9/1255* (2013.01); *B63C 2009/0058* (2013.01)

(58) Field of Classification Search

CPC .... A41D 13/0125; B63C 9/1255; B63C 9/11; B63C 9/125; B63C 9/08; B63C 9/081; F04B 33/005

USPC ..... 441/89, 90, 92, 96, 106, 107

See application file for complete search history.

(56) References Cited

U.S. PATENT DOCUMENTS

| | | | | |
|---|---|---|---|---|
| 2,607,934 | A * | 8/1952 | Bailhe | 441/107 |
| 4,972,971 | A | 11/1990 | Janko et al. | |
| 5,333,656 | A | 8/1994 | Mackal | |
| 5,694,986 | A | 12/1997 | Weinheimer et al. | |
| 5,746,633 | A | 5/1998 | Jeffrey | |
| 5,759,076 | A | 6/1998 | Bateman et al. | |
| 7,059,924 | B2 | 6/2006 | Farmer et al. | |
| 7,150,668 | B2 | 12/2006 | Kemp | |
| 7,699,679 | B2 | 4/2010 | Lahyani | |
| 8,104,096 | B1 | 1/2012 | Jenney | |
| 8,231,421 | B1 * | 7/2012 | Hubbard et al. | 441/92 |
| 8,353,736 | B2 * | 1/2013 | Wang | 441/93 |
| 2004/0082237 | A1 | 4/2004 | Farmer et al. | |
| 2010/0015867 | A1 | 1/2010 | Betz et al. | |
| 2012/0073466 | A1 | 3/2012 | Wang | |
| 2012/0202396 | A1 | 8/2012 | Hubbard et al. | |

OTHER PUBLICATIONS

International Search Report of PCT/2013/056121 Jan. 10, 2014.

* cited by examiner

*Primary Examiner* — Lars A Olson

(57) ABSTRACT

A flotation device that automatically inflates when contacted by water, but minimizes the risk of inadvertent inflation, includes an inflatable bladder that is coupled to a water-activated inflator device equipped with a water sensor. The water sensor is covered by a housing that prevents the flotation device from inflating inadvertently. The water sensor and housing are positioned on the upper back area of the wearer.

18 Claims, 7 Drawing Sheets

SPLASH-RESISTANT AUTOMATICALLY INFLATABLE FLOTATION DEVICE

CROSS-REFERENCE TO RELATED APPLICATION

This claims priority to U.S. provisional application 61/692,503, filed Aug. 23, 2012, which is incorporated by reference in its entirety.

FIELD OF THE INVENTION

The invention relates to personal flotation devices, and more particularly, to personal flotation devices that automatically inflate but not in response to inadvertent splashing.

BACKGROUND

Accidental drowning in swimming pools and natural bodies of water is a leading cause of death for people of all ages around the world. Drownings most commonly occur in recreational settings. The odds for a fatal unintentional drowning are particularly elevated for children, weak swimmers and non-swimmers. While thousands of drowning deaths are recorded each year in the U.S. alone, there are exponentially more hospitalizations due to near-drowning injuries. A large percentage of near-drowning victims suffer severe and permanent neurological disabilities, the effects of which often result in long-lasting psychological and emotional trauma for the victim, his or her family and their community. These injuries are known as "submersion injuries".

Submersion injuries mostly occur when least expected, often due to an unintentional slip or fall into a body of water. These accidents often happen while in the presence of others, although the victim often goes unnoticed for a period of time. The National Safe Kids Campaign (or, "NSKC") has reported an average of eighty-eight percent of children (under the age of fourteen) were under some form of supervision when they drowned. Once the victim's head is below the water level, drowning or submersion injuries can occur within seconds.

Supervision of children, weak swimmers, and non-swimmers (an average of three-quarters of drowning victims in the U.S. did not know how to swim) around any body of water is an essential preventive strategy, but inevitable lapses make supervision alone insufficient. There are a variety of flotation aids available on the market, but typical life preservers, or personal flotation devices ("PFDs"), often prove too bulky and uncomfortable for the wearer to feasibly use on a regular basis. In fact, according to the NSKC, an average of ninety-seven percent of children who drowned in pools or open bodies of water were not wearing a PFD at the time of the drowning. Over the years, inflatable technologies have been incorporated into PFDs in attempt to minimize the bulk in protective flotation devices.

Conventional flotation devices typically use compressed gas, chemical reactions, air/water pressure, electric motors, or manual/oral means to inflate an airtight bladder to create added buoyancy for a distressed victim in water. Inflatable bladders have been incorporated in vests, shirts, pants, backpacks, wetsuits, helmets, hats, swim shorts, belts, armbands, jackets, necklaces, and waist packs.

A disadvantage of many conventional inflatable flotation devices is they require a person in distress to manually actuate the inflating mechanism. While it may be simple to manually inflate the device in a non-emergency situation, the stress and panic associated with emergencies often prevent a person from being able to perform the simplest of actions. Thus manually-actuated flotation devices are not always useful in an emergency situation.

Flotation devices that include automatic water-activated inflators are known, but these devices are prone to inflating when they should not. They often inflate when it is raining or when they are simply splashed. Accordingly, when one wants to enjoy time around water and even splash in water without worrying about inflating the PFD he or she is wearing, these conventional devices are undesirable.

SUMMARY

I invented a personal flotation device that includes an automatic water-activated inflator, but my device minimizes inadvertent inflation events by preventing water from being able to contact the water sensor that activates the inflator unless the water enters a housing positioned over the water sensor and rises to the level of the water sensor. My flotation device inflates immediately upon immersion of the wearer's shoulders and head region in water, but resists inadvertent inflation from splashing, rain, and generally wet environments. Thus, it allows the wearer to enjoy and even splash in the water without inflation.

A personal flotation device, according to an embodiment of the invention, comprises a shirt having a front side, back side, and an inflatable bladder positioned along the front side beneath the shirt. An inflator device is coupled to the inflatable bladder so as to inflate the bladder automatically when the inflator device is contacted by water. The inflator device is positioned on the back side of the shirt at an upper back area of a wearer when worn. A housing on the device includes a cover made of water impermeable material covering the inflator device and adapted to prevent water from moving beneath the cover to contact the inflator device until the inflator device is substantially submerged in water.

The inflatable bladder may include an inflatable front section positioned over the wearer's chest and an inflatable rear section positioned behind the wearer's neck when the shirt is worn and the inflator device is positioned on the inflatable rear section.

A base member may be coupled to the cover to form a housing with the inflator device therein, where the cover is at least partially removable from the base member to provide access to the inflator device.

The inflator device may include a water sensor and a gas container that are located completely within the housing when the housing is closed.

The inflator device and housing are preferably positioned on the back side of the shirt at an upper back area of the wearer and between the wearer's shoulder blades when worn.

A personal flotation device, according to another embodiment of the invention, comprises an inflatable bladder that can be worn about a wearer's torso and includes an inflatable front section that is positioned over the wearer's chest and an inflatable rear section that is positioned behind the wearer's neck when worn. A gas container is coupled to the inflatable bladder in such a way that the gas container inflates the bladder with gas discharged therefrom. A water sensor is coupled to the inflatable bladder and is in operable communication with the gas container in such a way that gas discharged from the gas container inflates the bladder when the water sensor becomes wet. A housing is positioned along the inflatable rear section and includes a cover made of water impermeable material defining a chamber in which the water sensor is located. The cover prevents water from contacting the water sensor until water that enters the chamber through one or more openings in the housing and rises in the chamber a sufficient distance to contact the water sensor.

The housing and water sensor may be positioned along the inflatable rear section so as to be located on the wearer's upper back when the inflatable bladder is worn.

The housing and water sensor may be positioned along the inflatable rear section so as to be located on the wearer's upper back and between the wearer's shoulder blades when the inflatable bladder is worn.

The inflatable bladder may be coupled to and positioned on an interior of a shirt.

The housing may include a base member coupled to the cover, where the base member and cover together define the chamber, and the cover is at least partially removable from the base member to provide access to the chamber.

A cushion layer may be positioned between the base member and inflatable bladder and have a gas flow passage aligned with a port formed through the base member and in gas flow communication with the gas container for allowing gas discharged from the gas container to enter the inflatable bladder.

The water sensor and gas container are preferably located completely within the chamber when the chamber is closed.

A personal flotation, according to yet another embodiment of the invention, comprises a housing having a base member and a cover coupled together to define a hollow chamber located therebetween, the cover being at least partially removable from the base member to provide access to the hollow chamber. An inflator device is positioned within the housing and includes a gas container coupled to a water sensor that causes gas to discharge from the gas container when the water sensor becomes wet. A port is formed through the base member and is in gas flow communication with the gas container. One or more openings in the housing are offset from the water sensor for allowing water to enter the housing when the housing is dipped in water but also preventing splashed water from wetting the water sensor. An inflatable bladder is attached to the housing, is wearable about a body of a wearer, and is in gas flow communication with the port to receive gas discharged from the gas container.

A cushion layer may be positioned between the base member and inflatable bladder and includes a gas flow passage aligned with the port for allowing gas discharged from the gas container to enter the inflatable bladder.

The water sensor and gas container may be located completely within the chamber when the chamber is closed.

The inflatable bladder may be worn about a wearer's torso and includes an inflatable front section that is positioned over the wearer's chest and an inflatable rear section that is positioned behind the wearer's neck when worn. In this scenario, the housing is positioned along the inflatable rear section so as to be located on the wearer's upper back when the inflatable bladder is worn.

The housing is preferably positioned along the inflatable rear section so as to be located on the wearer's upper back and between the wearer's shoulder blades when the inflatable bladder is worn.

The one or more openings in the housing are preferably located beneath the water sensor when the inflatable bladder is worn.

The inflatable bladder may be coupled to and positioned on an interior of a shirt.

These and other advantages, aspects, and embodiments of the invention will be better understood by referring to the accompanying drawings and detailed description of preferred embodiments.

BRIEF DESCRIPTION OF THE DRAWINGS

Aspects of the invention will now be described with reference to the accompanying drawings in which.

DETAILED DESCRIPTION OF PREFERRED EMBODIMENTS

In the Summary above and in the Detailed Description of Preferred Embodiments, reference is made to particular features (including method steps) of the invention. Where a particular feature is disclosed in the context of a particular aspect or embodiment of the invention, that feature can also be used, to the extent possible, in combination with and/or in the context of other particular aspects and embodiments of the invention, and in the invention generally.

The term "comprises" is used herein to mean that other ingredients, features, steps, etc. are optionally present. When reference is made herein to a method comprising two or more defined steps, the steps can be carried in any order or simultaneously (except where the context excludes that possibility), and the method can include one or more steps which are carried out before any of the defined steps, between two of the defined steps, or after all of the defined steps (except where the context excludes that possibility).

In this section, the invention will be described more fully with reference to certain preferred embodiments. This invention may, however, be embodied in many different forms and should not be construed as limited to the embodiments set forth herein. Rather, these embodiments are provided so that this disclosure will convey preferred embodiments of the invention to those skilled in the art.

Figure 1:
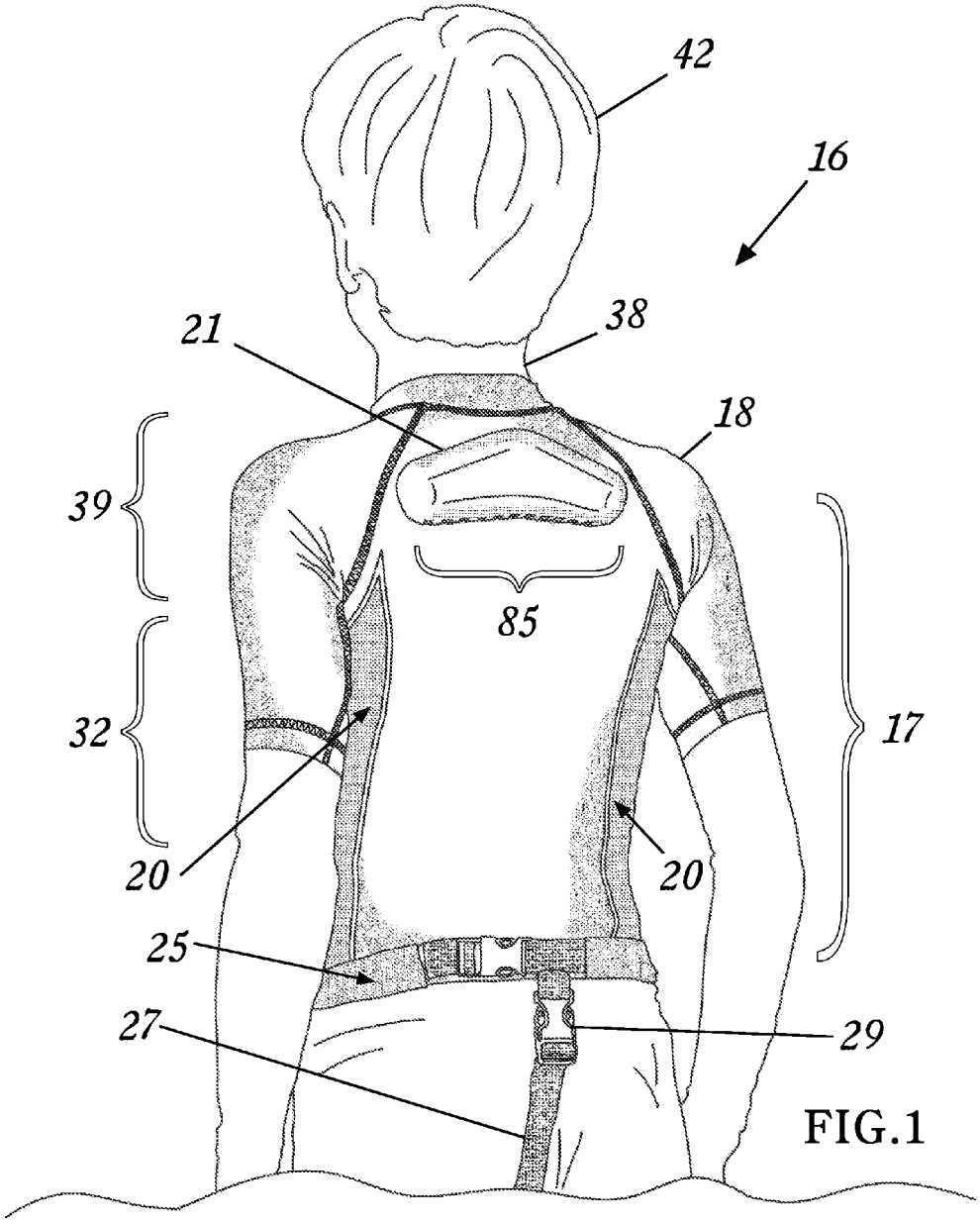
FIG. 1 is a back perspective view of a person wearing a shirt including a wearable personal flotation device according to a preferred embodiment of the invention.
Figure 2:
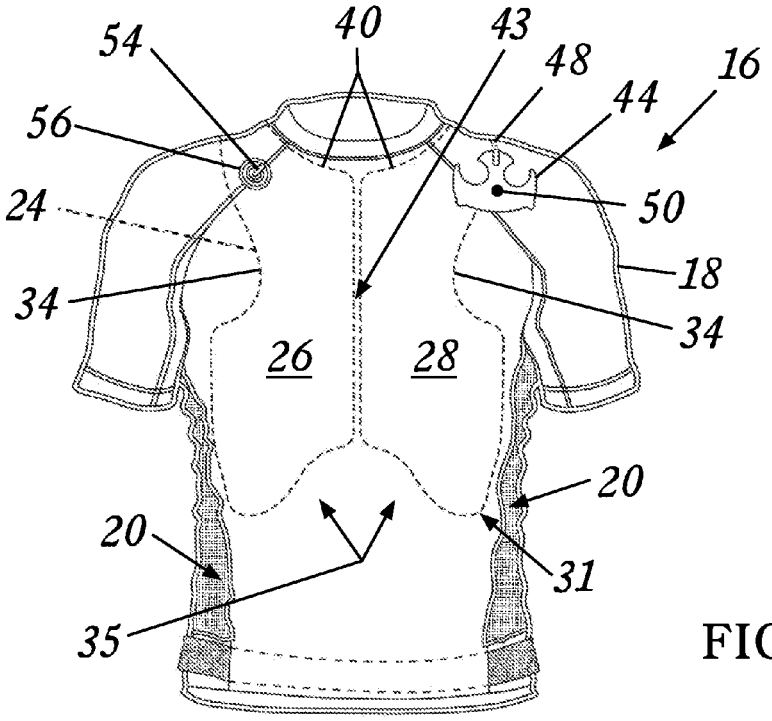
FIG. 2 is a front view of the shirt of FIG. 1, showing an inflatable bladder in broken lines built in to the shirt.
Figure 3:
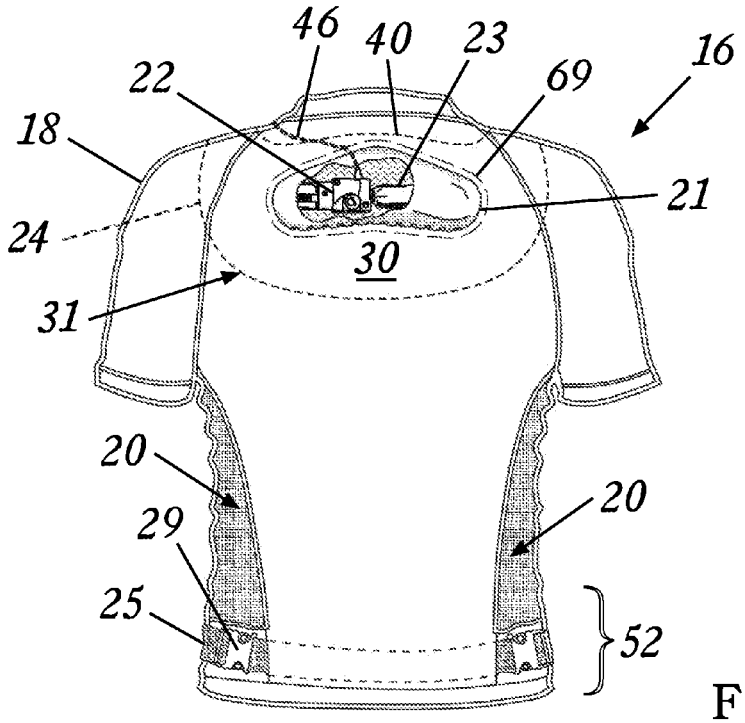
FIG. 3 is a back view of the shirt of FIG. 1, showing the inflatable bladder in broken lines built in to the shirt and showing a partial cut-away view of an inflator device housing.

Referring first to FIGS. 1-3, a personal flotation device 16, according to a preferred embodiment of the invention, is adapted to be a substantially form-fitting and non-bulky flotation aid that inflates when the wearer submerges their head and/or shoulders under water. In the embodiment shown, the personal flotation device 16 is designed to be worn about the torso 17 of a male or female wearer, whether a child or an adult, as one would wear a shirt. The personal flotation device 16 includes: a shirt 18, preferably with side venting panels 20 made of a mesh material; an inflator housing 21; a waistband 25; and crotch strap 27, both with buckles, preferably of the snap-lock type 29.

The shirt 18 is preferably made of an elastic material such as Lycra, spandex, nylon, polyester, cotton, or a combination thereof, which is both form fitting to the wearer's torso 17 and allows the shirt 18 to stretch upon inflation. The shirt 18 may be long sleeved, short sleeved, sleeveless, tank top or any other style in popular fashion; additionally, the shirt 18 may feature a crew neck, v-neck or polo neck styles. Given that the shirt 18 is preferably form-fitting and non-bulky, a wearer may wear the flotation device 16 underneath a layer of outer clothing such as a fishing shirt or work shirt.

Venting panels 20 may be stitched into the lateral side sections of the shirt 18. Venting panels 20 are preferably made with a breathable textile mesh material that enables the shirt to efficiently vent off body heat, preventing excessive sweat, and making the flotation device 16 comfortable to wear both in and out of the water.

The waistband 25 is preferably adjustable and made of nylon material. The waistband 25 is preferably incorporated into the torso-encircling waist portion 52 of the flotation device 16. The waistband 25 is secured by one or more side-release snap-lock buckles 29 and may additionally include a crotch strap 27 that extends between the wearer's legs to keep the safety garment 16 securely affixed to the wearer in the water after inflation. The waist portion 52 of the shirt 18 may be constructed of a heavier and thicker waterproof material, such as neoprene, to provide a comfort buffer between the wearer and the waistband 25. Alternatively, an external belt 80, secured by loop fasteners 82, may be used instead of an integrated waistband 25.

In this embodiment, the personal flotation device 16 includes an inflatable bladder 24 which may be removably secured to the shirt 18 by use of an integrated internal stitched liner (not explicitly illustrated) that forms a pocket within the shirt 18 and generally follows the contour outline of the inserted bladder 24. The bladder has attached upon it an inflator 22 attached to a gas container 23 that contains compressed gas such as carbon dioxide, air, nitrogen, oxygen or the like, that is arranged to release compressed gas into the bladder 24 once the gas container 23 is triggered by the inflation mechanism. The inflatable bladder 24, when inflated, is responsible for keeping the wearer afloat and is fluid-tight such that the gas used to inflate the bladder 24 cannot escape therefrom and water cannot enter therein. The bladder 24 can be manufactured from plastics, UV resistant fabrics, PV coated nylon fabric, nylon coated neoprene, or similar marine suitable materials.

The bladder 24 includes an inflatable front section having a front right panel 26, a front left panel 28 and an inflatable rear section having a rear panel 30. When placed within the internal stitched liner 31 of the shirt 18, the front panels 26 and 28 are positioned on the front side of the wearer's torso 17, over the wearer's chest, while the rear panel is positioned behind the wearer's neck 38 and in an area generally defined as the rear upper torso 39.

When the bladder 24 is placed in the internal liner 31 of the shirt 18, the front panels 26 and 28 come together in a parallel configuration on the front of the personal flotation device 16, forming a longitudinally expandable union 43 over the wearer's sternum. In a similar fashion, the pairing of front panels 26 and 28 collectively form a lower concave shape 35 along the bottom edge of the bladder 24 consistent with the lower edge of the wearer's ribcage 32. The anatomically considerate design implements 35 and 43 are contemplated to be more comfortable and less restrictive, allowing the wearer to twist, bend and breathe more freely due to less hindrance and/or bunching of the bladder 24 in both uninflated and inflated states. The expandable union 43 of the bladder 24, when placed within the internal stitched liner 31 of swim shirt 18, also provides for expansive relief across the chest, which allows the personal flotation device 16 to conform to different torso shapes and breast sizes of various wearers, thus making the garment more comfortable and adaptable to a wider range of body shapes and sizes. This provides a considerable design improvement over certain prior inflatable bladders that are formed by a singular front panel that spans the entire width of a wearer's upper torso.

In addition, the alignment of front panels 26 and 28 form concave outer side edges 34 in assembly, that correspond with the wearer's front upper torso 39, specifically the major pectoral regions, and collectively form a general hourglass shape. This hourglass shape allows the wearer to freely move their arms about in any direction without resistance or hindrance by the internal inflatable bladder 24 in both uninflated and inflated states. Additionally, when the bladder 24 is placed within the internal stitched liner 31, it forms a generally circular head opening 40 for receiving the head 42 of the wearer therethrough.

The flotation device 16 may incorporate features and components that allow the wearer to override the auto-inflation feature and manually inflate the bladder 24 by pulling a manual activation handle 44 located on the upper front shoulder area. The activation handle 44 is connected to the inflation mechanism 22 by a rip cord 46, which is channeled through the shirt 18 via a stitched conduit 48 within the internal liner 31. The activation handle 44 is made of thermoformed plastic and is attached to the shirt 18 by an integrated post snap 50, which holds the activation handle 44 firmly in place. The closure unit (not shown) of the post snap 50 is made of a non-corrosive material and is stitched, or riveted, onto the shirt 18, and the attaching unit (not shown) of the post snap 50 is thermoformed onto the back side of the activation handle 44.

The activation handle 44 and rip cord 46 are positioned over the upper front left panel 28 of the bladder 24 in such a manner for a user to have unobstructed and quick access to the handle 44 to inflate the bladder 24 when desired. In a situation where a wearer is in distress in the water and has only seconds to react, assuming the manual override handle is required for inflation, the location of handle 44 on safety garment 16, corresponds to a location that would most likely be out of the water, assuming the distressed victim is floating at the surface. This provides a considerable design improvement over certain conventional personal flotation devices that locate manual inflation handles in areas that would be below the surface of the water, such as at the waistline, and therefore most likely obstructed from view, and/or likely to confuse to a distressed victim trying to stay afloat.

After an inflation event, air trapped in the bladder 24 can be purged through a release valve 54 that penetrates the shirt 18 in the upper front shoulder area. The release valve 54 may also be used to orally inflate the bladder 24, by means of the user manually blowing into valve 54. The release valve 54 may be concealed by a flap 56 made of elastic fabric that is secured to the swim shirt 18, having a free end which may be folded over to cover the release valve 54 and releasably held in the folded-over position, such as with hook and loop style fasteners, or other waterproof closure devices.

Figure 4:
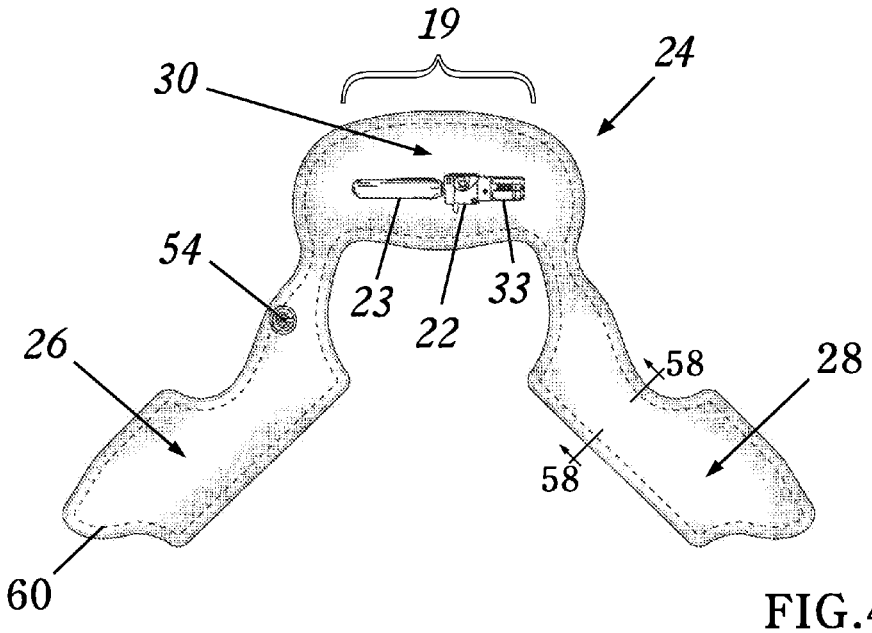
FIG. 4 is a front view of the inflatable bladder outside of the shirt.
Figure 5:
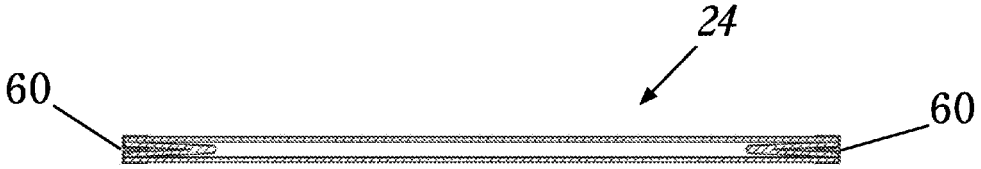
FIG. 5 is a cross-section view of an inflatable bladder of the wearable personal flotation device of FIG. 4 taken on lines 58-58 of FIG. 4 in a deflated configuration.
Figure 5A:
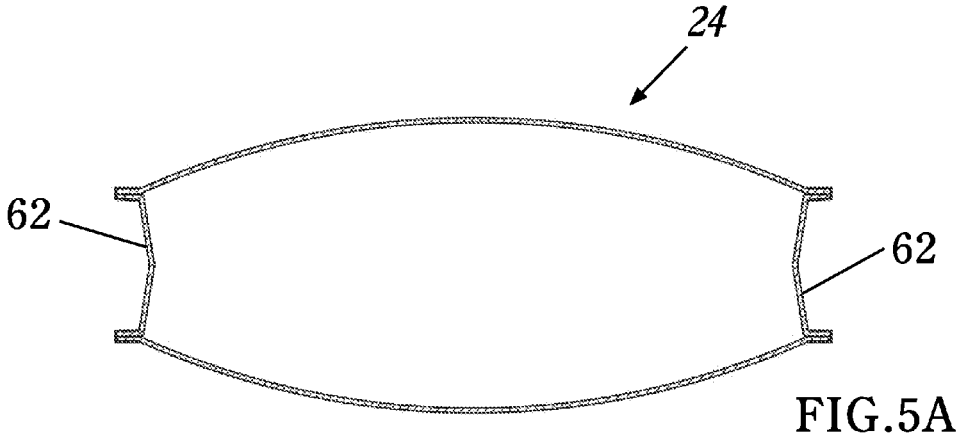
FIG. 5A is the same cross-section view as FIG. 5 but the inflatable bladder is in an inflated configuration.

FIGS. 4-5A show an example of the bladder 24 absent the shirt 18. The bladder 24 is manufactured in a flattened state, but when folded over and placed within the swim shirt 18, it forms an ergonomically considerate design that compliments the contours of the human body. The bladder 24 has a rear panel 30, which in an inflated state creates an air chamber resembling a pillow behind the wearer's head 42. The bladder 24 is formed with two or more layers of material that are sealed around their perimeter to define a sealed gas chamber within. The bladder may be sealed in a variety of ways commercially known such as ultrasonic welding, radio frequency welding, and/or an adhesive. The continuous design of the bladder 24 allows a single gas container 23 to fully inflate the bladder 24. With a majority of the air volume contained in chambers 26 and 28, which relates to the front side upper torso 39 of the wearer, bladder 24 is specifically designed to orient and float the wearer in a chest up, or head up, position upon activation under water. This self-righting ability of safety garment 16 is especially valuable for young and weak swimmers, and would assist in keeping the air passageways of unconscious victims from sinking below the water.

An accordion-type fold 60 may be integrated into the sidewalls 62 of bladder 24. The accordion-type fold 60 is implemented to allow for a larger maximum air capacity of the bladder 24 than other commercially known prior inflatable bladders, while also maintaining a minimum profile in the uninflated state to provide a comfortable fit for the wearer. Alternatively, the bladder may be designed with a pleated fold to increase the maximum air capacity when inflated or the bladder may be designed without a side wall.

The inflation mechanism 22 is attached to the bladder 24 at the rear panel 30 as can be noted in FIG. 4. When folded into the shirt 18, this location correlates to the wearer's back upper torso 39, or between the wearer's shoulder blades 85. Preferably, the inflation mechanism 22 has a threaded sleeve (not shown) and a water sensor 33 having a water-soluble capsule or dissolving disk (not shown) that will disintegrate upon submersion in water, triggering the puncture of the gas container 23, which has a threaded neck (not shown) for cooperative engagement with a sleeve of the inflation mechanism 22. Suitable inflator devices 19 are commercially available by various manufacturers, including Halkey Roberts of St. Petersburg, Fla. Typically, the gas container 23 has a soft seal (not shown) that is easily pierced when necessary to inflate the bladder 24, so that upon piercing the seal, gas releases from the gas container 23 and passes through the inflation mechanism 22, which is in gas flow communication with bladder 24, thereby inflating the bladder 24. After a gas container 23 has been used, the bladder 24 may be deflated and the inflator device 19 rearmed with a replacement gas container 23 so that the personal flotation device 16 may be reused multiple times.

When the personal flotation device 16 is equipped with manual override components, the piercing member (not shown) may be manually activated by pulling on handle 44 attached to a tensile rip cord 46 which, in turn, is connected to a piercing member in the inflation mechanism 22 responsible for piercing the soft seal of the gas container 23 thereby releasing gas into the inflation mechanism 22 and subsequently into the bladder 24 to inflate the same (FIG. 5A).

When the flotation device 16 is assembled, the inflator device 19 is conveniently located on the exterior of the shirt 18 in an area consistent with the wearer's upper back and torso 39, which places the inflator device 19 out of sight and unobtrusive to the wearer. This provides a considerable design improvement over conventional PFDs that locate inflation assemblies within the liner or beneath the shirt, and/or in locations that may provide discomfort or obstruction to the wearer.

Figure 8:
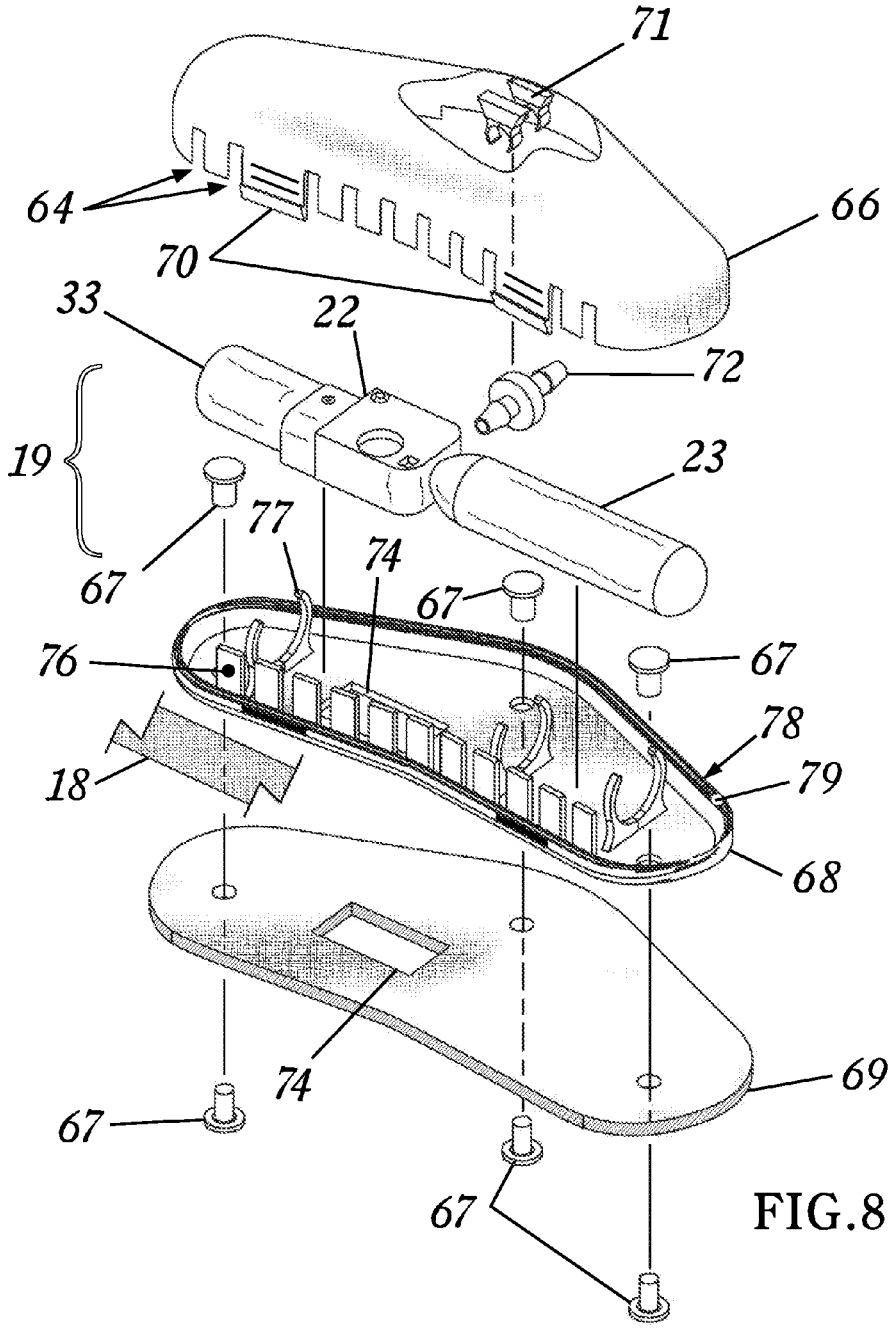
FIG. 8 is an exploded view of the inflator housing of FIGS. 6 and 7.

In an embodiment of the invention, and as illustrated in FIG. 8, the inflator device 19 is contained within a splash-proof inflator device housing 21, which mounts to the exterior of the shirt 18 in an area consistent with the wearer's upper back and torso 39. The housing 21 also effectively serves as a shield for the water sensor 33 to prevent inadvertent activation of the inflation mechanism 22 by exposure to water contacting the flotation device 16, other than an actual submersion.

The housing 21 allows the flotation device 16 not only to function in wet recreational environments, while minimizing the chances for unintended inflation, but specifically allows the wearer to submerge themselves in water up to chest deep without activating the inflation mechanism 22. This function allows the wearer to play and/or relax in water environments, assuming that the wearer is not submerged in water above their shoulders, without concern that the auto-inflation mechanism will be activated. Specifically, the inflation housing 21 prohibits water from entering and contacting the water reactive part 33 of the inflator device 19, except through slotted vent openings 64 and 76 located at the lower portion of the assembled housing 21. Water entering through the vent openings 64 and 76 would indicate a submersion event has occurred, and would trigger inflation of the bladder 24.

The housing 21 is preferably made from a rigid thermoformed plastic and is comprised of two main assembly components, a cover 66 and a base member 68, which join together to define a chamber and conceal the inflator device 19 within. The housing 21 can be oriented in a horizontal (FIG. 6) or vertical (FIG. 9) configuration on the shirt 18. The housing 21 is connected to the shirt 18 by non-corrosive mechanical fasteners 67 as shown, and/or by adhesive (not shown). A layer of spongy waterproof material, such as neoprene, may serve as a cushion layer 69, cushioning the housing 21 against the wearer's back 39. When assembled, the cover 66 and base member 68 are joined together with integrated snap latches 70, or by other mechanical means, which also provide easy disassembly of the housing 21 to access the inflator device 19.

The cover 66 is formed with integrated pipe clips 71 to secure an air pressure valve 72. Additionally, the base member 68 is formed with integrated pipe clips 77 to secure the inflator device 19. Base member 68 features a port 74 formed therethrough to allow gas from the gas container 23 to flow into the bladder 24. The cushion layer 69 includes a gas flow passage 74 formed therethrough that is aligned with the port 74 for allowing the gas to pass to the bladder 24.

The base member 68 is formed with a set of internal vents 76 that may be positioned to offset with the alignment of the vent openings 64 on the cover 66 when joined together. The base member 68 may feature an integrated channel 78 along its perimeter edge that retains a rubber gasket 79 to further seal the housing 21 against splashing, when assembled. When paired together, vent openings 64 and 76 disallow splashed water (such as from recreational playing, rain, rinsing, showering, and the like) to gain access to the water reactive part 33 of the inflation assembly 19, thus creating a "splash-resistant" anti-submersion system.

Figure 6:
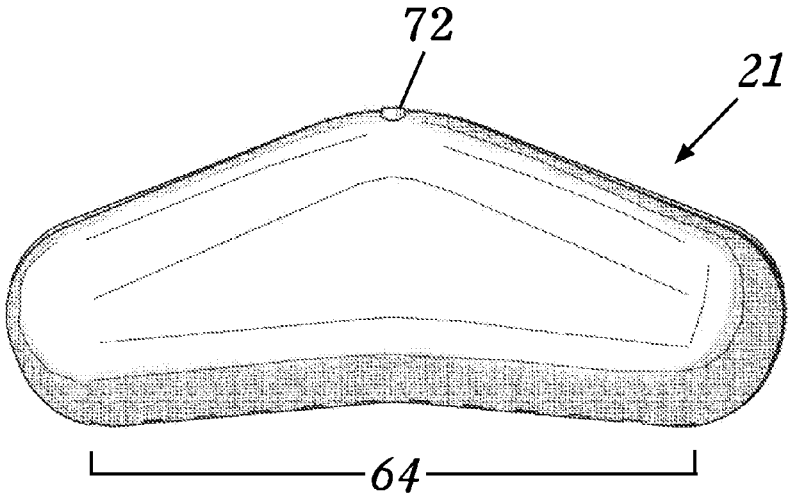
FIG. 6 is a back view of an exemplary inflator housing detached from the inflatable bladder.

FIG. 6 illustrates the housing 21 arranged horizontally.

Figure 7:
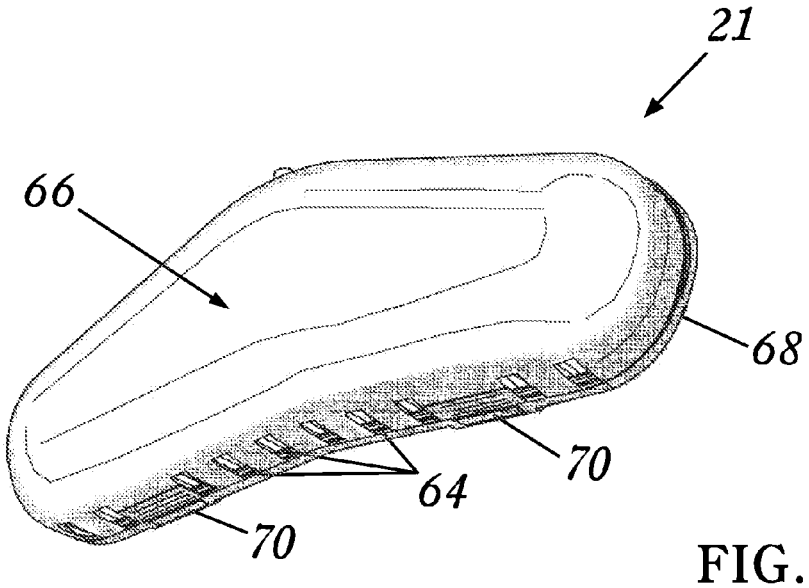
FIG. 7 is a back perspective view of the inflator housing of FIG. 6.

FIG. 7 depicts a perspective view of the inflation housing 21 in which the cover 66 and base member 68 have been joined as in use.

FIG. 8 is an exploded view of a horizontally configured housing 21, showing a detail of its components and the containment of the inflator device 19.

Figure 9:
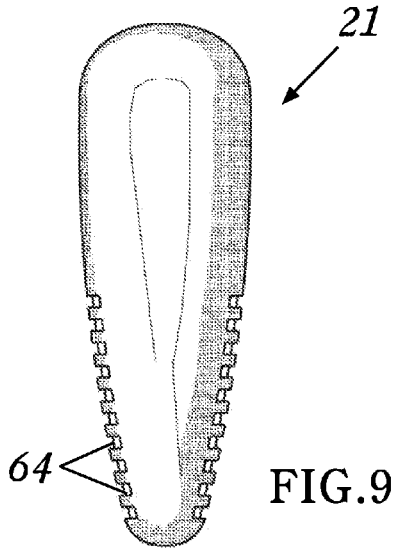
FIG. 9 is a back view of another example of the inflator housing.
Figure 10:
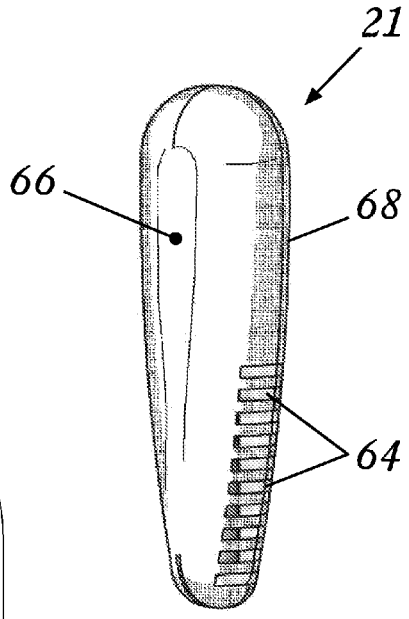
FIG. 10 is a back perspective view of the inflator housing of FIG. 9.
Figure 11:
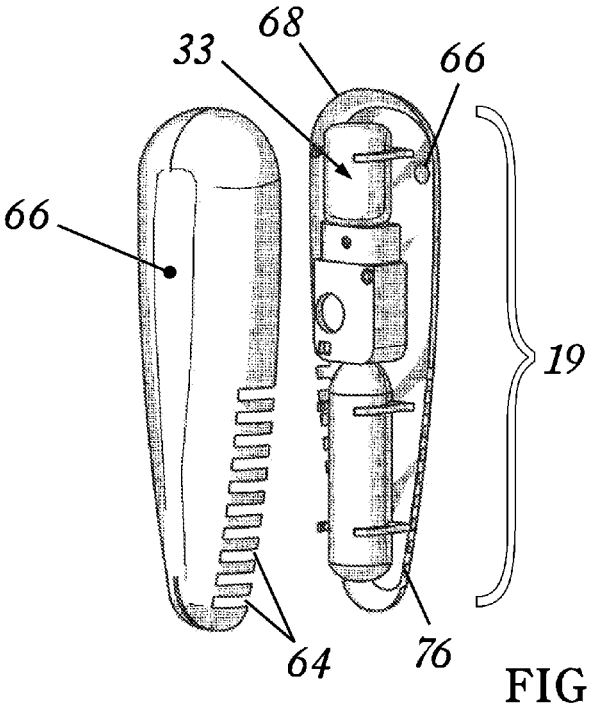
FIG. 11 is an exploded view of the inflator housing of FIGS. 9 and 10.
Figure 12:
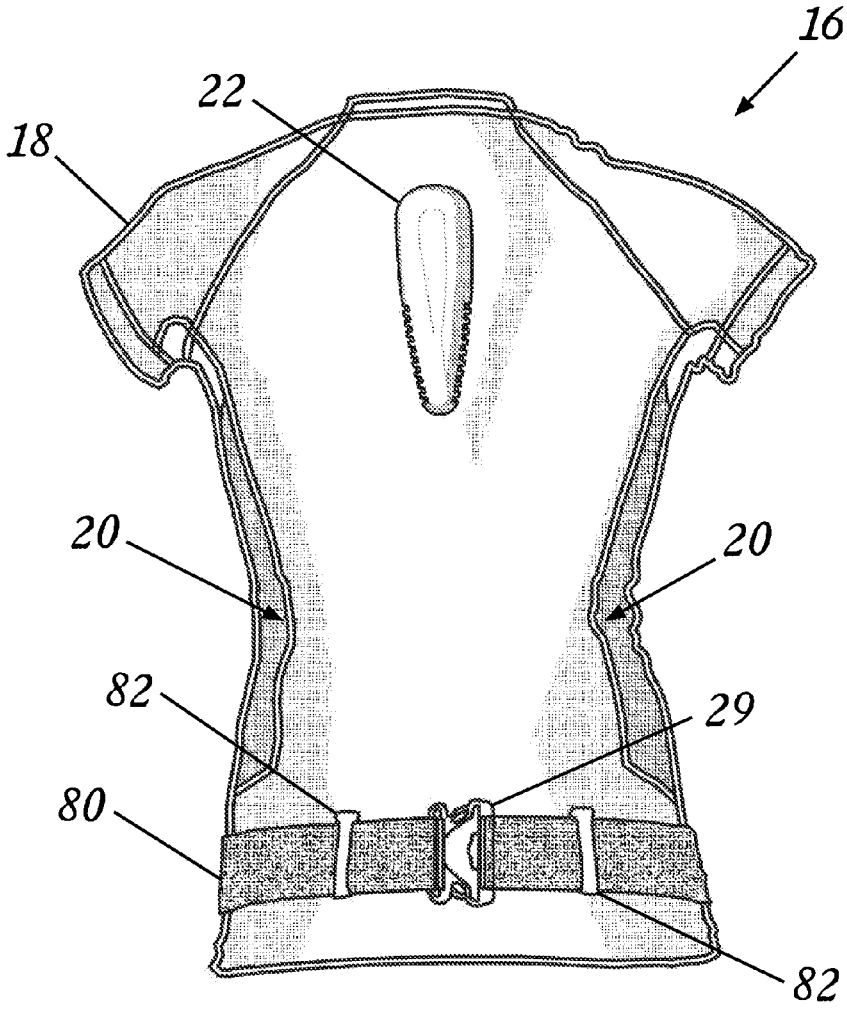
FIG. 12 is a back view of a shirt, including a wearable personal flotation device having the inflator housing of FIGS. 9-11.

FIG. 9 illustrates an alternate example of the housing 21 in a vertical configuration. FIG. 10 is a perspective view of the housing 21 of FIG. 9 in which the snap cover 66 and base plate 68 have been joined as in use. FIG. 11 is an exploded view the vertically configured inflation housing 21 of FIG. 9, showing the containment and orientation of the inflator device 19. FIG. 12 shows an example of how the inflator housing of FIG. 9 may be arranged on a short-sleeved shirt 18.

The invention has been described above with reference to preferred embodiments. Although various methods and materials similar or equivalent to those described herein can be used in the practice or testing of the present invention, suitable methods and materials are described. However, the skilled should understand that the methods and materials used and described are examples and may not be the only ones suitable for use in the invention.

That which is claimed is:

1. A personal flotation device comprising:

a shirt having a front, a back and a liner on an underside of the front and back;

an inflatable bladder positioned between the shirt and the liner and comprising front right and left panels that come together in a parallel and spaced apart configuration on the front of the shirt forming a longitudinally expandable union over a wearer's sternum, the front right and left panels having a lower concave shape along a bottom edge thereof consistent with a lower edge of the wearer's ribcage, and a rear panel on the back of the shirt and positioned to be behind the wearer's neck;

an inflator device coupled to the inflatable bladder so as to inflate the inflatable bladder when the inflator device is contacted by water, the inflator device being positioned on the back of the shirt at an upper back area of the wearer when worn; and a housing having a cover made of water impermeable material covering the inflator device and adapted to prevent water from moving beneath the cover to contact the inflator device until the inflator device is substantially submerged in water.

2. The personal flotation device of claim 1, wherein a base member is coupled to the cover to form a housing with the inflator device therein and the cover is at least partially removable from the base member to provide access to the inflator device.

3. The personal flotation device of claim 2, wherein the inflator device includes a water sensor and a gas container that are located completely within the housing when the housing is closed.

4. The personal flotation device of claim 1, wherein the inflator device and housing are positioned on the back side of the shirt at an upper back area of the wearer and between the wearer's shoulder blades when worn.

5. The personal flotation device of claim 1, wherein the inflatable bladder has sidewalls, and an accordion-type fold integrated into the sidewalls.

6. A personal flotation device comprising:

an inflatable bladder that can be worn about a wearer's torso and comprising an inflatable front section that is positioned over the wearer's chest and comprising front right and left panels that come together in a parallel and spaced apart configuration to form a longitudinally expandable union over the wearer's sternum, the front right and left panels having a lower concave shape along a bottom edge thereof consistent with a lower edge of the wearer's ribcage, and an inflatable rear section comprising a rear panel that is positioned behind the wearer's neck when worn;

a gas container coupled to the inflatable bladder to inflate the inflatable bladder when gas is discharged therefrom;

a water sensor coupled to the inflatable bladder and in operable communication with the gas container so that the inflatable bladder is inflated by the gas container when the water sensor becomes wet; and a housing positioned along the inflatable rear section, including a cover made of water impermeable material defining a chamber in which the water sensor and gas container are located, the cover preventing water from contacting the gas container and the water sensor until water that enters the chamber through one or more openings in the housing and rises in the chamber to contact the water sensor.

7. The personal flotation device of claim 6, wherein the housing and water sensor are positioned along the inflatable rear section so as to be located on the wearer's upper back when the inflatable bladder is worn.

8. The personal flotation device of claim 7, wherein the housing and water sensor are positioned along the inflatable rear section so as to be located on the wearer's upper back and between the wearer's shoulder blades when the inflatable bladder is worn.

9. The personal flotation device of claim 6, wherein the inflatable bladder is coupled to and positioned on an interior of a shirt.

10. The personal flotation device of claim 6, wherein the housing includes a base member coupled to the cover, the base member and cover together define the chamber, and the cover is at least partially removable from the base member to provide access to the chamber.

11. The personal flotation device of claim 10, further comprising a cushion layer positioned between the base member and inflatable bladder and having a gas flow passage aligned with a port formed through the base member and in gas flow communication with the gas container for allowing gas discharged from the gas container to enter the inflatable bladder.

12. The personal flotation device of claim 6, wherein the water sensor and gas container are located completely within the chamber when the chamber is closed.

13. A personal flotation device comprising:

a housing comprising a base member and a cover coupled together to define a chamber located therebetween, the cover being at least partially removable from the base member to provide access to the chamber;

an inflator device positioned within the chamber and comprising a gas container, and a water sensor coupled to the gas container that causes gas to discharge from the gas container when the water sensor becomes wet, with the water sensor and the gas container being located completely within the chamber;

a port formed through the base member in gas flow communication with the gas container;

one or more openings in the housing offset from the inflator device for allowing water to enter the housing when the housing is dipped in water but also preventing splashed water from wetting the water sensor;

an inflatable bladder attached to the housing, wearable about a body of a wearer, and in gas flow communication with the port to receive gas discharged from the gas container.

14. The personal flotation device of claim 13, further comprising a cushion layer positioned between the base member and inflatable bladder and having a gas flow passage aligned with the port for allowing gas discharged from the gas container to enter the inflatable bladder.

15. The personal flotation device of claim 13, wherein the inflatable bladder can be worn about a wearer's torso and includes an inflatable front section that is positioned over the wearer's chest and an inflatable rear section that is positioned behind the wearer's neck when worn; and the housing is positioned along the inflatable rear section so as to be located on the wearer's upper back when the inflatable bladder is worn.

16. The personal flotation device of claim 15, wherein the housing is positioned along the inflatable rear section so as to be located on the wearer's upper back and between the wearer's shoulder blades when the inflatable bladder is worn.

17. The personal flotation device of claim 13, wherein the one or more openings in the housing are located beneath the water sensor when the inflatable bladder is worn.

18. The personal flotation device of claim 13, wherein the inflatable bladder is coupled to and positioned on an interior of a shirt.

* * * * *